US011682819B2

(12) United States Patent
Schuster et al.

(10) Patent No.: US 11,682,819 B2
(45) Date of Patent: Jun. 20, 2023

(54) MILLIMETER-WAVE RESONATOR AND ASSOCIATED METHODS

(71) Applicant: THE UNIVERSITY OF CHICAGO, Chicago, IL (US)

(72) Inventors: David Schuster, Chicago, IL (US); Aziza Suleymanzade, Cambridge, MA (US); Jonathan Simon, Chicago, IL (US); Alexander Anferov, Chicago, IL (US)

(73) Assignee: The University of Chicago, Chicago, IL (US)

( * ) Notice: Subject to any disclaimer, the term of this patent is extended or adjusted under 35 U.S.C. 154(b) by 51 days.

(21) Appl. No.: 17/452,654

(22) Filed: Oct. 28, 2021

(65) Prior Publication Data

US 2022/0140463 A1 May 5, 2022

Related U.S. Application Data

(60) Provisional application No. 63/107,987, filed on Oct. 30, 2020.

(51) Int. Cl.
*H01P 1/219* (2006.01)
*H01P 7/04* (2006.01)
(Continued)

(52) U.S. Cl.
CPC ..... *H01P 7/04* (2013.01); *H01P 1/209* (2013.01); *H01P 1/219* (2013.01); *H01P 11/008* (2013.01)

(58) Field of Classification Search
CPC .. H01P 1/219; H01P 1/20; H01P 1/207; H01P 1/209; H01P 7/04; H01P 7/00; H01P 11/001; H01P 11/002; H01P 11/008; H01P 11/00; H01P 3/00; H01P 3/12; H01P 3/127
See application file for complete search history.

(56) References Cited

U.S. PATENT DOCUMENTS 3,657,668 A * 4/1972 Craven ..... H01P 1/182 333/122
4,725,796 A * 2/1988 Youree ..... H01P 1/2138 333/135
6,253,444 B1 * 7/2001 Le Neve ..... H01P 1/022 29/601

OTHER PUBLICATIONS

Hunger et al., Fiber Fabry-Perot Cavity With High Finesse, arXiv:1005.0067v1 [physics.optics] May 1, 2010, 24 pages.
(Continued)

*Primary Examiner* — Stephen E. Jones
(74) *Attorney, Agent, or Firm* — Cozen O'Connor

(57) ABSTRACT

A millimeter-wave resonator is produced by drilling a plurality of holes into a piece of metal. Each hole forms an evanescent tube having a lowest cutoff frequency. The holes spatially intersect to form a seamless three-dimensional cavity whose fundamental cavity mode has a resonant frequency that is less than the cutoff frequencies of all the evanescent tubes. Below cutoff, the fundamental cavity mode does not couple to the waveguide modes, and therefore has a high internal Q. Millimeter waves can be coupled into any of the tubes to excite an evanescent mode that couples to the fundamental cavity mode. The tubes also provide spatial and optical access for transporting atoms into the cavity, where they can be trapped while spatially overlapping the fundamental cavity mode. The piece of metal may be superconducting, allowing the resonator to be used in a cryogenic environment for quantum computing and information processing.

21 Claims, 10 Drawing Sheets

(51) Int. Cl.
*H01P 11/00* (2006.01)
*H01P 1/209* (2006.01)

(56) References Cited

OTHER PUBLICATIONS

Reagor et al., Reaching 10 ms Single Photon Lifetimes for Superconducting Aluminum Cavities, arXiv:1302.4408v2 [cond-mat.supr-con] May 22, 2013, 4 pages.
Kuhr et al., Ultrahigh Finesse Fabry-Perot Superconducting Resonator, arXiv:quant-ph/0612138v2, Jul. 17, 2007, 3 pages.
Leduc et al., Titanium Nitride Films for Ultrasensitive Microresonator Detectors, arXiv:1003.5584v2 [cond-mat.supr-con], Aug. 9, 2010, 4 pages.

* cited by examiner

MILLIMETER-WAVE RESONATOR AND ASSOCIATED METHODS

RELATED APPLICATIONS

This application claims priority to U.S. Provisional Patent Application No. 63/107,987, filed Oct. 30, 2020 and titled "Tunable High-Q Superconducting MM-Wave Cavities for Circuit and Cavity QED Experiments", the entirety of which is incorporated herein by reference.

STATEMENT REGARDING FEDERALLY SPONSORED RESEARCH OR DEVELOPMENT

This invention was made with government support under grant number DMR-1420709 awarded by the National Science Foundation, and grant number W911NF-15-1-0397 awarded by the Army Research Office. The government has certain rights in the invention.

BACKGROUND

Millimeter waves are used in many fields of science and technology. For example, advances in millimeter-wave detection have been used for observational cosmology and studies of the cosmic microwave background. Terahertz and near-terahertz radiation are also promising for hazardous chemical sensing and effective medical diagnostics. Millimeter-waves have been explored for increasing the bandwidth and reducing the latency of wireless communications.

SUMMARY

Cavity and circuit quantum electrodynamics (QED) systems provide unprecedented control over photonic quantum states via coupling to strongly nonlinear single emitters. This effort began with pioneering work in Rydberg cavity QED, including the demonstration of nonclassical micromaser radiation, Schrodinger cat states, and early EPR experiments. Since then, cavity and circuit QED systems have become essential tools for exploring quantum phenomena both in the optical and microwave regimes. Hybrid systems, which cross-couple these regimes, can harness the strengths of optical systems for communication and microwave systems for quantum information processing, yielding a more powerful toolset for quantum information technology. In particular, the coherent interconversion of microwave and optical photons could enable large quantum networks and robust transfer of quantum information.

Millimeter waves are promising for hybrid quantum science at less-explored, but potentially beneficial, length and energy scales. First, resonances near 100 GHz with long coherence times are abundant in commonly-used quantum emitters (e.g., Rydberg atoms, molecules, silicon vacancies) though they are rarely harnessed due to a lack of both high-Q resonators with tight mode confinement and mature millimeter-wave technology. Second, the mean thermal photon occupation of a 100-GHz resonator at 1 K is $n_{ph}=(e^{h\nu/k_bT}-1)^{-1}=0.009<<1$. This puts millimeter-wave resonators in the quantum regime at temperatures accessible with a simple pumped $^4$He cooling system having much larger cooling power and lower cost and complexity than the dilution refrigerators required to reach ~20 mK for experiments at 10 GHz. Third, the intermediate length scale of millimeter-waves enables development of scalable high-Q devices using both near and far-field wave engineering techniques. Last, millimeter-wave resonators are generally smaller than their microwave counterparts, and therefore require less power to cool, are less expensive to fabricate, and have improved thermal uniformity. A smaller size can also cause millimeter-wave resonators to be stiffer than their microwave counterparts at lower frequencies, and therefore less prone to mechanical and acoustical pick-up.

The present embodiments include three-dimensional (3D) resonators with high internal Qs and fundamental frequencies up to several hundred gigahertz. These resonators feature a completely seamless design, sub-wavelength mode volume, and abundant optical access to the strongly confined mode. Typically composed of two pieces, 3D cavities are vulnerable to photon leakage through the seam between the pieces, which is more pronounced in cavities with shorter wavelengths. This leakage can reduce the internal Q. In the present embodiments, the cavity mode is formed in the pocket formed by several intersecting evanescent tubes. Since an intersection of any two dissimilar bodies creates a pocket with a larger cross section than each of them separately, this intersection yields at least one bound state below cutoff (i.e., below the lowest cutoff frequency of each and every one of the evanescent tubes). Indeed, any arbitrarily weak defect in one dimension has this property, albeit with weaker localization. The number of evanescent tubes and their diameters determines the resonant frequency, while the locations of the intersections and the angles between the evanescent tubes control the localization of the fundamental mode and symmetries of higher-order modes.

The present embodiments may be advantageously fabricated by drilling holes into a piece of metal. Due to the high electrical conductivity of the walls, these holes form evanescent tubes (i.e., hollow electromagnetic waveguides with a lowest cutoff frequency that is non-zero). In fact, the holes may have the same diameter, in which case the entire millimeter-wave resonator may be fabricated with a single drill bit or end mill. As described in more detail below, there are a myriad resonator geometries that can be fabricated in this manner. Different geometries give rise to different spectra of the mode frequencies, and may be selected according to design requirements.

The present embodiments also include hybrid resonators that combine optical and millimeter-wave cavities in a single structure. The evanescent tubes forming the millimeter-wave resonator also provide spatial and optical access for transporting quantum emitters (e.g., atoms or molecules) into the millimeter-wave cavity and optically trapping these quantum emitters within the mode of the millimeter-wave cavity. These quantum emitters may then serve as a transducer for coherent and bidirectional interconversion of millimeter-wave and optical photons. Such a transducer could be used, for example, to transfer quantum states between optical and millimeter-wave quantum systems with high fidelity.

While the present embodiments are particularly advantageous when operating in the millimeter-wave region of the electromagnetic spectrum (i.e., 30-300 GHz), the resonators presented herein may be configured to operate at other frequencies without departing from the scope hereof. Specifically, the evanescent tubes may be increased in size such that the fundamental mode of the 3D cavity lies below the millimeter-wave region (e.g., microwave, radio-frequency, etc.). Alternatively, the evanescent tubes may be decreased in size such that the fundamental mode lies above the millimeter-wave region (e.g. sub-millimeter-wave, terahertz).

In embodiments, a millimeter-wave resonator is produced by drilling into a piece of metal (i) a first hole forming a first evanescent tube having a first cutoff frequency and (ii) a second hole forming a second evanescent tube having a second cutoff frequency. The first and second holes at least partially intersect to form a seamless three-dimensional cavity whose fundamental cavity mode has a resonant frequency that is less than the first and second cutoff frequencies.

In other embodiments, a millimeter-wave resonator includes a piece of metal forming first and second evanescent tubes that extend linearly into the piece of metal from an external surface of the piece of metal. The first and second evanescent tubes at least partially intersect to form a seamless three-dimensional cavity whose fundamental cavity mode has a resonant frequency that is less than a first cutoff frequency of the first evanescent tube and a second cutoff frequency of the second evanescent tube.

In other embodiments, a millimeter-wave resonator includes a plurality of evanescent tubes that intersect to form a seamless three-dimensional cavity. Each of the plurality of evanescent tubes has a cut-off frequency. The seamless three-dimensional cavity has a fundamental cavity mode whose resonant frequency is less than a cutoff frequency of each of the plurality of evanescent tubes.

In other embodiments, a millimeter-wave method includes cryogenically cooling any millimeter-wave resonator of the present embodiments to a temperature below a critical temperature of the metal. The millimeter-wave method also includes coupling millimeter-waves into the first evanescent tube to excite an evanescent mode of the first evanescent tube. The evanescent mode couples to at least one cavity mode of the seamless three-dimensional cavity. The at least one cavity mode has a resonant frequency less than the first and second cutoff frequencies.

DETAILED DESCRIPTION

Figure 1:
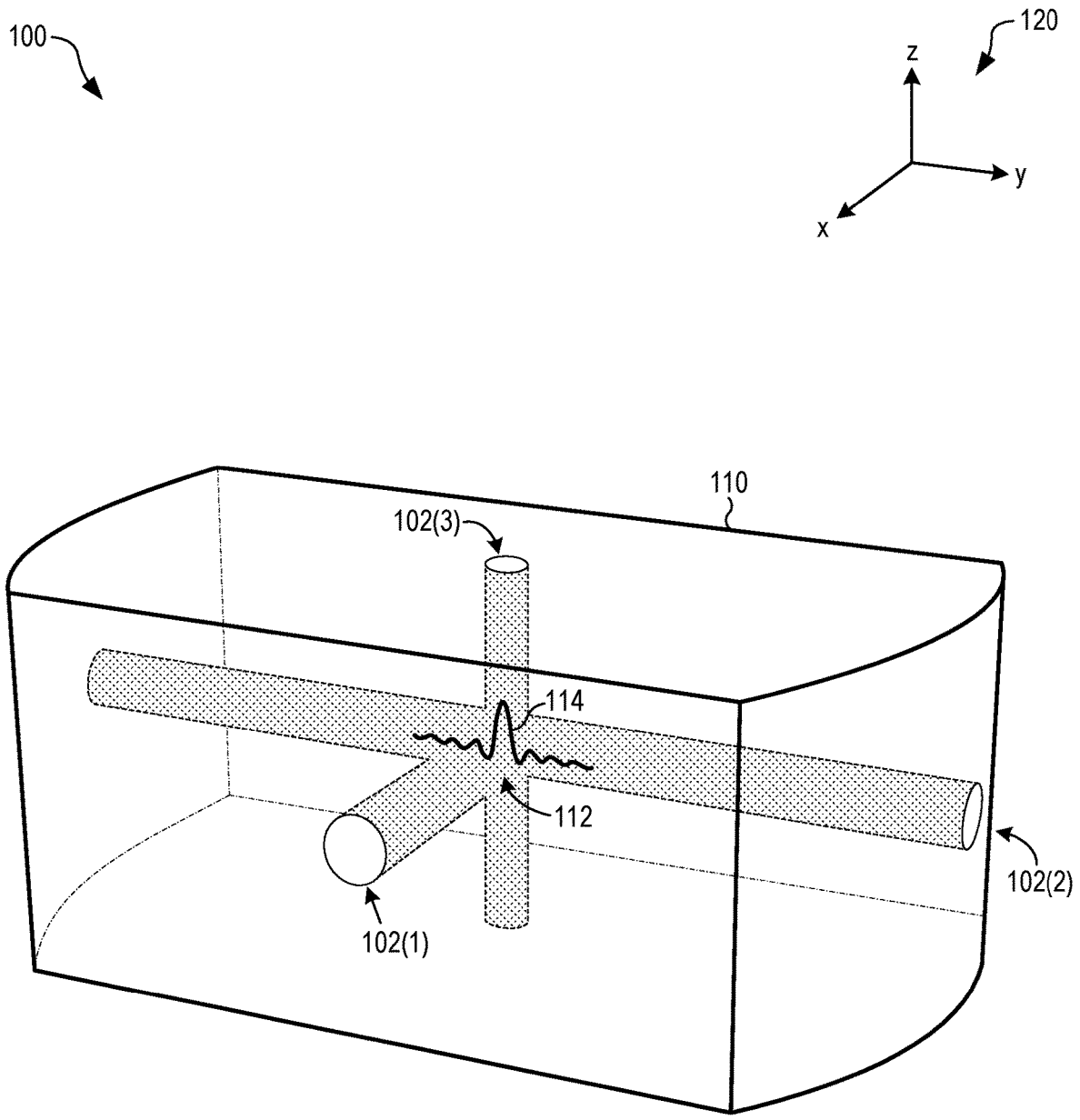
FIG. 1 shows a millimeter-wave resonator formed by a plurality of evanescent tubes that intersect within a piece of metal, in an embodiment.

FIG. 1 shows a millimeter-wave resonator 100 formed by a plurality of evanescent tubes 102 that intersect within a piece of metal 110. Specifically, the resonator 100 has a first evanescent tube 102(1), a second evanescent tube 102(2), and a third evanescent tube 102(2) that intersect to form a seamless three-dimensional (3D) cavity 112 whose fundamental cavity mode 114 has a resonant frequency below the cutoff frequency of each evanescent tube 102. The 3D cavity 112 is "seamless" in that the line formed where each pair of evanescent tubes 102 intersect is free from any kind of crack, opening, transition, or other type of spatial discontinuity that could reduce the electrical conductivity of the walls, inhibit the flow of electrical currents along the walls, or cause leakage of electromagnetic fields.

An evanescent tube is a hollow electromagnetic waveguide operating below its lowest cutoff frequency, i.e., the cutoff frequency of the fundamental waveguide mode. When operating above cutoff, the propagation constant of the waveguide is complex, indicating the existence of a waveguide mode, i.e., a solution to the wave equations in which oscillating electric and magnetic fields form a wave whose energy propagates along the length of the waveguide. When operating below cutoff, the propagation constant is purely real. In this case, the solution to the wave equations is an evanescent field whose energy does not propagate along the waveguide. These evanescent fields are also referred to herein as "evanescent modes". No waveguide mode exists below the lowest cutoff frequency.

Figure 2A:
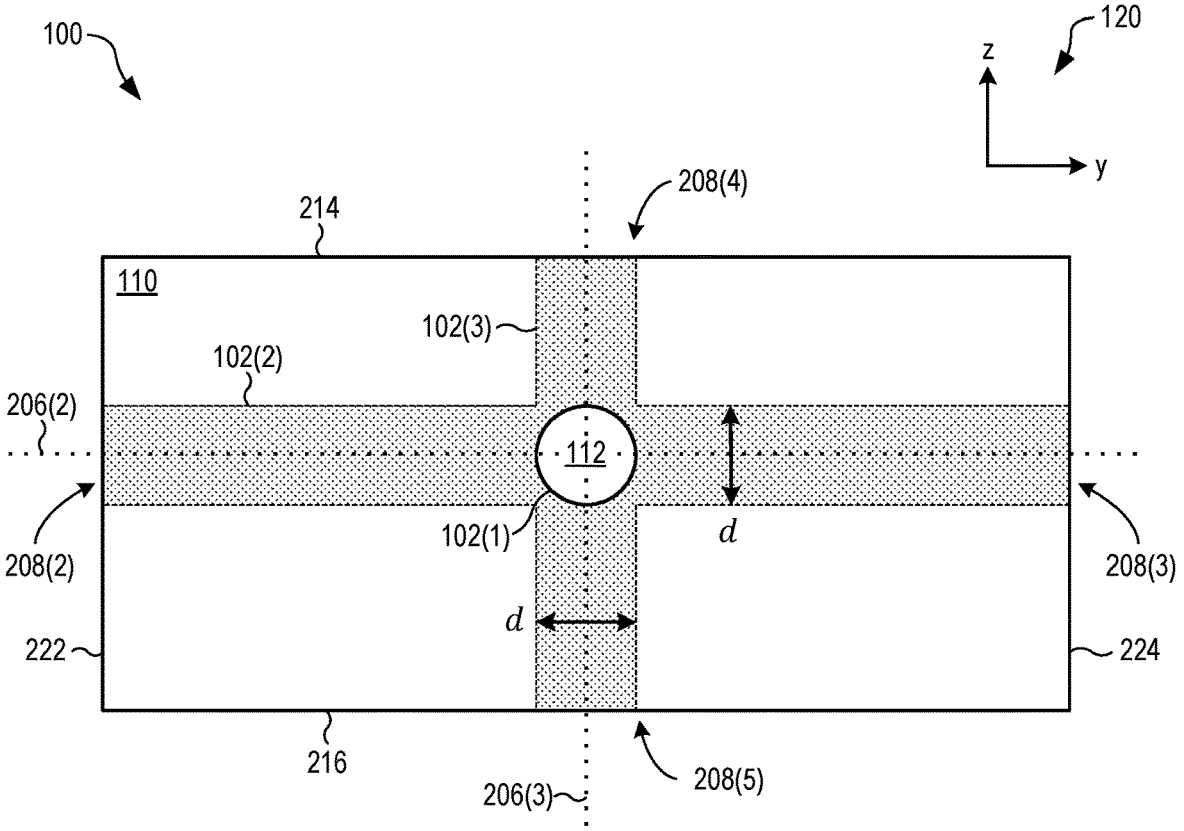
FIG. 2A shows a top view of the millimeter-wave resonator of FIG. 1.
Figure 2B:
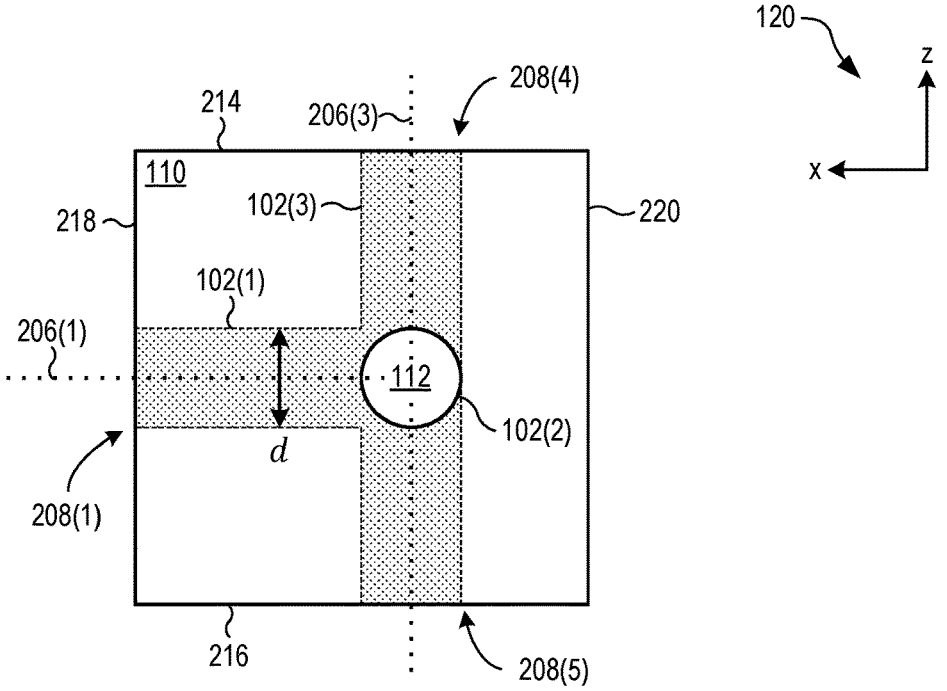
FIG. 2B shows a side view of the millimeter-wave resonator of FIG. 1.

FIGS. 2A and 2B show top and side views, respectively, of the millimeter-wave resonator 100 of FIG. 1. In FIGS. 2A and 2B, projections of the evanescent tubes 102 are indicated by the shaded regions. A right-handed coordinate system 120 is shown for reference. FIGS. 2A and 2B are best viewed together with the following description.

The first evanescent tube 102(1) extends lengthwise, along a first tube axis 206(1) that is parallel to the x axis, between a front external face 218 of the piece of metal 110 and the 3D cavity 112. Thus, the first evanescent tube 102(1) does not intersect a rear external face 220 of the piece of metal 110. The intersection of the first evanescent tube 102(1) with the front external face 218 forms a first port 208(1). The second evanescent tube 102(2) extends lengthwise, along a second tube axis 206(2) that is parallel to the y axis, between side external faces 222 and 224. The intersection of the second evanescent tube 102(2) with the side external face 222 forms a second port 208(2), and the intersection of the second evanescent tube 102(2) with the side external face 224 forms a third port 208(3). The third evanescent tube 102(3) extends lengthwise, along a third tube axis 206(3) that is parallel to the z axis, between a top external face 214 and a bottom external face 216. The intersection of the third evanescent tube 102(3) with the top external face 214 forms a fourth port 208(4), and the intersection of the third evanescent tube 102(3) with the bottom external face 216 forms a fifth port 208(5).

For clarity, all of the external faces of the piece of metal 110 (e.g., the external faces 214, 216, 218, 220, 222, and 224) are collectively referred to herein as the "external surface" of the piece of metal 110. The external surface may define any kind of three-dimensional geometric shape. For example, FIGS. 2A-2B show the piece of metal 110 as a right rectangular prism in which all of the external faces 214, 216, 218, 220, 222, and 224 are planar. The piece of metal 110 may be alternatively shaped as another type of prism or polyhedron, such as an oblique rectangular prism, hexagonal prism, or cuboid. Alternatively, one of more of the external faces may be curved. For example, FIG. 1 shows the side external faces 222 and 222 as being curved. Accordingly, the piece of metal 110 may be shaped as a cylinder, sphere, half-cylinder, cone, or ellipsoid.

As described in more detail below, electromagnetic waves may be coupled into the resonator 100 via any of the five ports 208(1)-208(5), where they excite evanescent modes in the evanescent tubes 102 that couple with the 3D cavity 112. While FIGS. 1 and 2A-2B show the resonator 100 having three evanescent tubes 102, the resonator 100 may have any number of two or more intersecting evanescent tubes 102 without departing from the scope hereof. Furthermore, while FIGS. 1 and 2A-2B show the resonator 100 having two evanescent tubes 102 that pass entirely through the piece of metal 110 and one evanescent tube 102 that passes only partially through the piece of metal 110, the resonator 100 may alternatively have any number of evanescent tubes 102 that pass entirely through the piece of metal 110, any number of evanescent tubes 102 that pass partially through the piece of metal 110, or a combination thereof. In some embodiments, the resonator 100 has only evanescent tubes 102 that pass entirely through the piece of metal 110. In other embodiments, the resonator 100 has only evanescent tubes 102 that pass partially through the piece of metal 110.

In FIGS. 1 and 2A-2B, the evanescent tubes 102 are cylindrical and have the same diameter d. Thus, the cross section of the first evanescent tube 102(1) in the plane perpendicular to the first tube axis 206(1) is a circle of diameter d, the cross section of the second evanescent tube 102(2) in the plane perpendicular to the second tube axis 206(2) is also a circle of diameter d, and the cross section of the third evanescent tube 102(3) in the plane perpendicular to the third tube axis 206(3) is also a circle of diameter d. However, the evanescent tubes 102 may have different diameters without departing from the scope hereof. In other embodiments, the evanescent tubes 102 have different cross-sectional shapes (e.g., square, rectangle, octagon, oval, race-track, etc.) or a combination of cross-sectional shapes. FIGS. 1 and 2A-2B show the evanescent tubes 102 extending linearly into the piece of metal 110 (i.e., each tube axis 206 is a straight line). However, there is no requirement that the evanescent tubes 102 be linear, provided that the intersection of the evanescent tubes 102 supports a fundamental cavity mode 114 whose resonant frequency is below the cutoff frequencies of all of the evanescent tubes 102. Accordingly, some of the present embodiments include one or more evanescent tubes 102 that are curved (i.e., having a tube axis 206 shaped as a curved line).

The intersection of two or more dissimilar bodies creates a pocket with a larger cross section than each of the dissimilar bodies alone. In the example of FIGS. 1 and 2A-2B, each cross section taken through the 3D cavity 112 has an area greater than or equal to the cross-sectional area $\pi(d/2)^2$ of each of the evanescent tubes 102. It is due to this greater area that the fundamental cavity mode 114 has a resonant frequency below the cutoff frequencies of all of the evanescent tubes 102. When the evanescent tubes 102 have different diameters, they will have different cutoff frequencies. In this case, the resonant frequency will be less than the lowest cutoff frequency of each and every one of the evanescent tubes 102. For clarity, this condition is referred to herein simply as "below cutoff". Furthermore, while FIG. 1 shows only the fundamental cavity mode as being below cutoff, the 3D cavity 112 may support additional cavity modes that are also below cutoff. Similar arguments hold for evanescent tubes 102 that are not cylindrically shaped.

The resonator 100 may be fabricated by drilling holes into the piece of metal 110. For example, a blind hole may be drilled into the front external face 218 to create the first evanescent tube 102(1) and port 208(1). A first through hole may be drilled into the side external face 222 to create the second evanescent tube 102(2) and ports 208(2) and 208(3). A second through hole may be drilled into the top external face 214 to create the third evanescent tube 102(3) and ports 208(4) and 208(5). Here, "drilling" includes any process that can make holes via cutting or removal of material. Examples of such processes include, but are not limited to, milling, grinding, reaming, core drilling, laser cutting, chemical etching, or a combination thereof.

In the millimeter region of the electromagnetic spectrum, the radius of these drilled holes will be between $r_1=1.841c/(2\pi f)=2.93$ mm for f=30 GHz and $r_2=1.841c/(2\pi f)=0.293$ mm for f=300 GHz. Drill bits, end-mills, and reamers with radii between these values of $r_1$ and $r_2$ are commercially available, thereby allowing the millimeter-wave resonator 100 to be easily configured for use at any of several frequencies in the millimeter-wave region. Larger-diameter holes can be created such that the resonant frequency is below the millimeter-wave region (e.g., microwave or radio-frequency region) of the electromagnetic spectrum. Similarly, smaller-diameter holes can be created in the piece of metal 110 such that the resonant frequency is above the millimeter-wave region (e.g., terahertz region).

The evanescent tubes 102, and therefore the 3D cavity 112, have walls that are electrically conductive. In general, the higher the electrical conductivity, the higher the Q of the cavity mode. In the example of FIGS. 1 and 2A-2B, the piece of metal 110 may be fabricated from copper, silver, aluminum, nickel, titanium, steel, or another type of metal or metal alloy. The metal may also be superconducting, such as niobium, to achieve the highest electrical conductivities.

In some embodiments, the resonator 100 is fabricated by drilling holes into the piece of metal 110, after which the holes are coated (e.g., via sputtering or vapor deposition) with a different type of metal to create the evanescent tubes 102. Accordingly, the resonator 100 is not limited to only one type of metal. For example, the piece of metal 110 may be a piece of copper into which holes are drilled. The holes may then be coated with silver or gold. In this case, the copper provides low cost and excellent thermal conductivity while the silver or gold provides high electrical conductivity that ensures a high Q. In another example, holes drilled into a piece of aluminum may be coated with niobium. This example combines the low cost and high thermal conductivity of aluminum with the high superconductivity transition temperature of niobium. This example may be particularly useful for superconducting applications of the resonator 100.

To ensure a high Q, the walls of the evanescent tubes 102 need only be electrically conductive to within several skin depths. Thus, in some embodiments the piece of metal 110 is replaced with a piece of different material. Holes formed in this different material may then coated with high-conductivity metal to form the evanescent tubes 102. Examples of such materials includes crystalline silicon, gallium arsenide, sapphire, and other crystals. For many of these crystalline materials, holes can be ground using conventional grinding tools (e.g., diamond drill bits). Additional examples of non-metallic materials that may be used in lieu of the piece of metal 110 include fused quartz, amorphous silicon, glass, ceramics, and laminates (e.g., FR-4 and G10). Another type of material may be used without departing from the scope hereof.

To reduce electrical surface losses of the walls of the evanescent tubes 102 and the 3D cavity 112, the piece of metal 110 may be cleaned in solvents and chemically etched after the holes have been drilled therein. For example, the piece of metal 110 may be etched in a buffered chemical polishing (BCP) bath of $2H_3PO_4$:$HNO_3$:HF for 20 minutes at room temperature. However, other cleaning and etching techniques may be used without departing from the scope hereof. When the evanescent tubes 102 are created via metal coatings, cleaning and etching may occur prior to the coating, after the coating, or both. After rinsing and drying, the resonator 100 may be stored under vacuum or in an inert atmosphere to avoid oxidation of the surfaces (which will increase electrical surfaces losses of the walls).

Figure 3:
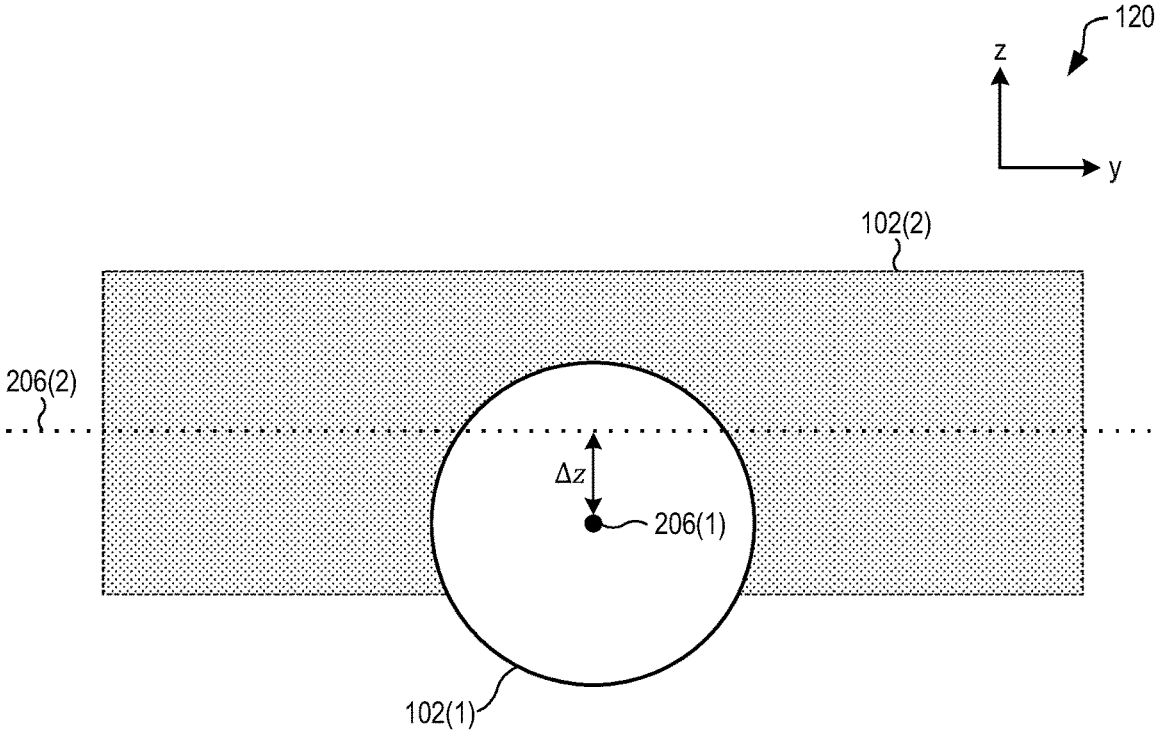
FIG. 3 is side view of an alternative geometry of the millimeter-wave resonator of FIGS. 1 and 2A-2B, in an embodiment.
Figure 4:
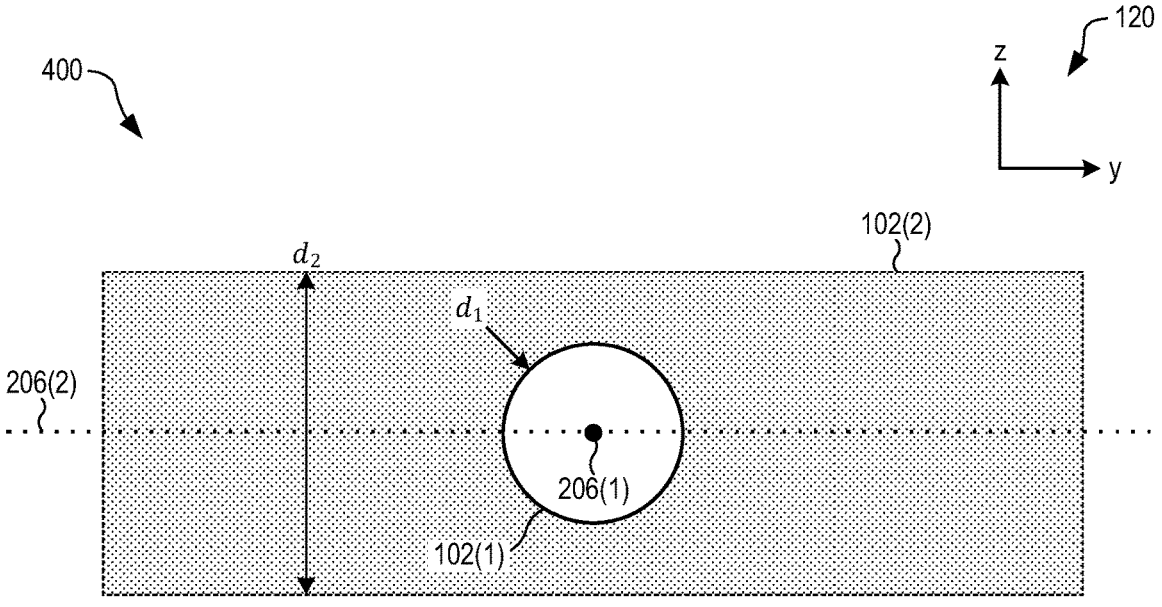
FIG. 4 is side view of another alternative geometry of the millimeter-wave resonator of FIGS. 1 and 2A-2B, in an embodiment.

FIGS. 3 and 4 are side views of alternative geometries of the millimeter-wave resonator 100 of FIGS. 1 and 2A-2B. In FIG. 3, the evanescent tubes 102(1) and 102(2) have the same diameter, but the evanescent tube 102(1) is displaced in the −z direction by Δz relative to the evanescent tube 102(2). As a result, the tube axes 206(1) and 206(2) do not intersect. Provided that Δz is less than the diameter of the evanescent tubes 102(1) and 102(2), the evanescent tubes 102(1) and 102(2) will partially overlap to form the 3D cavity 112. In this case, the evanescent tubes 102(1) and 102(2) "partially intersect" even though the tube axes 206(1) and 206(2) do not intersect. By contrast, the evanescent tubes 102 of FIGS. 1 and 2A-2B "fully intersect" in that the tubes axes 206(1), 206(2), and 206(3) intersect at one point. Although not shown in FIG. 3, these arguments also apply to the third evanescent tube 102(3) and third tube axis 206(3).

In FIG. 4, the evanescent tubes 102(1) and 102(2) intersect (i.e., the tube axes 206(1) and 206(2) intersect), but the diameters of the evanescent tubes 102(1) and 102(2) are different. As a result, a portion of the evanescent tube 102(2) passes over (i.e., in the +z direction) the evanescent tube 102(1) while another portion of the evanescent tube 102(2) passes under (i.e., in the −z direction) the evanescent tube 102(1). The evanescent tubes 102(1) and 102(2) still partially overlap to form the 3D cavity 112. In this case, the evanescent tubes 102(1) and 102(2) "partially intersect" while the tube axes 206(1) and 206(2) intersect. Although not shown in FIG. 4, these arguments also apply to the third evanescent tube 102(3) and third tube axis 206(3).

FIGS. 3 and 4 demonstrate that the evanescent tubes 102, regardless of their diameters, may partially or fully intersect each other to form the 3D cavity 112, and therefore it is not necessary for the tube axes 206 to intersect. More generally, the evanescent tubes 102 intersect when a continuous path exists between each pair of ports 208(*i*) and 208(*j*), where i and j index the ports 208 and i≠j. Those trained in the art should recognize that these arguments also apply to non-cylindrical evanescent tubes, or a plurality of evanescent tubes having different shapes.

Figure 5A:
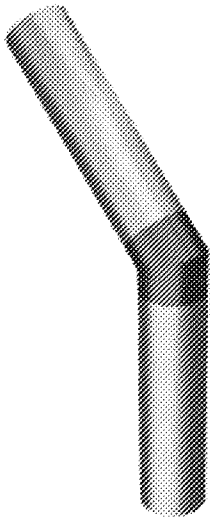
FIG. 5A shows an "elbow" geometry in which two evanescent tubes of the same diameter fully intersect each other at an obtuse angle, in an embodiment.

FIGS. 5A-5E show alternative geometries of the millimeter-wave resonator 100 of the FIG. 1. FIG. 5A shows an "elbow" geometry in which two evanescent tubes of the same diameter fully intersect each other at an obtuse angle. When these evanescent tubes have a diameter of 1.6 mm (i.e., a lowest cutoff frequency of 109.5 GHz), they form a 3D cavity whose fundamental cavity mode has a resonant frequency near 109 GHz. It should also be apparent from FIG. 5A that there is no requirement that the evanescent tubes intersect perpendicularly, i.e., evanescent tubes intersecting at oblique angles (either acute or obtuse) may also form a 3D cavity whose fundamental cavity mode is below cutoff.

Figure 5B:
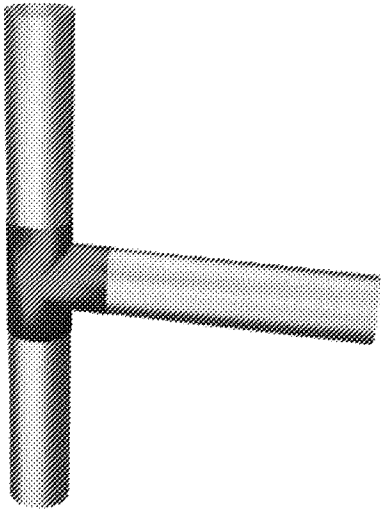
FIG. 5B shows a "tee" geometry formed from two intersecting evanescent tubes, in an embodiment.
Figure 5C:
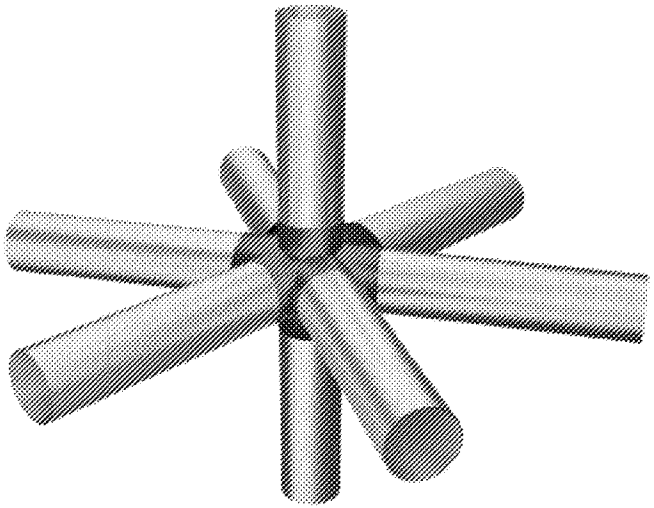
FIG. 5C shows a "star" geometry formed from four intersecting evanescent tubes, in an embodiment.
Figure 5D:
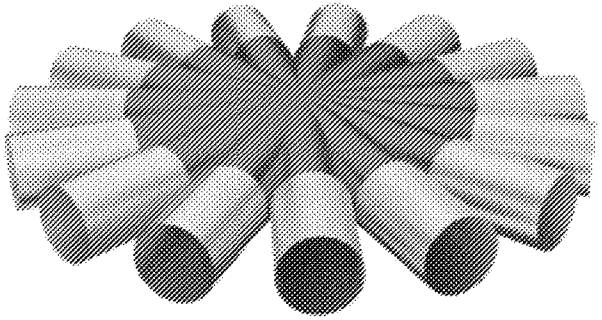
FIG. 5D shows a quasi-cylindrical geometry formed from fifteen intersecting evanescent tubes, in an embodiment.

FIG. 5B shows a "tee" geometry formed from two intersecting evanescent tubes, FIG. 5C shows a "star" geometry formed from four intersecting evanescent tubes, and FIG. 5D shows a quasi-cylindrical geometry formed from fifteen intersecting evanescent tubes. For evanescent tubes with a diameter of 1.6 mm, the tee geometry has a fundamental cavity mode at 98 GHz, the star geometry has a fundamental cavity mode at 92 GHz, and the quasi-cylindrical geometry has a fundamental cavity mode at 30 GHz. All of these geometries may be fabricated by drilling holes into a piece of metal.

In FIGS. 5A-5D, all of the evanescent tubes intersect at, or near, a single point that is located near the center of the resulting 3D cavity. In this case, only one 3D cavity is created. Furthermore, the greater the number of intersecting evanescent tubes, the greater the size of the 3D cavity and therefore the lower the resonant frequency. Thus, while FIGS. 5A-5D show millimeter-wave resonators with as many as fifteen intersecting evanescent tubes, more than fifteen such tubes may be used instead without departing from the scope hereof.

Figure 5E:
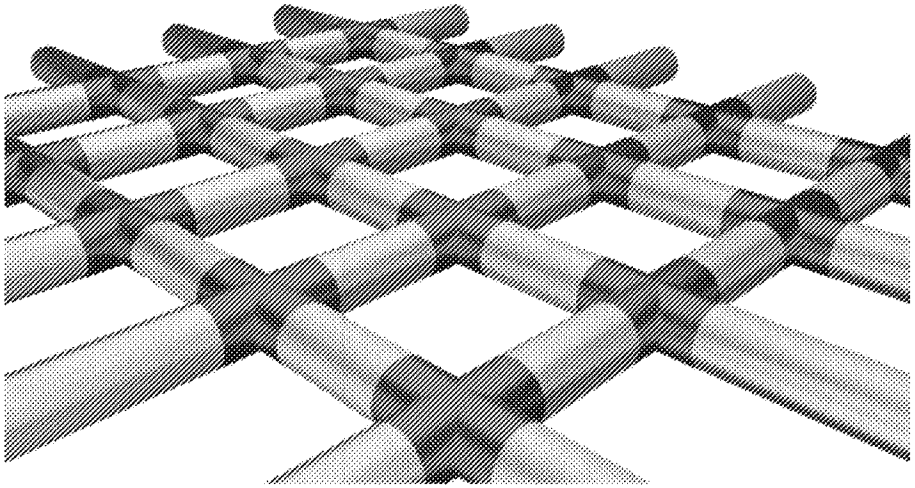
FIG. 5E shows a two-dimensional lattice of intersecting evanescent tubes, in an embodiment.

FIG. 5E shows a two-dimensional (2D) lattice of intersecting evanescent tubes. The geometry of FIG. 5E differs from those in FIGS. 5A-5D in that the evanescent tubes do not all intersect at a single point. Specifically, the 2D lattice forms one 3D cavity where each pair of evanescent tubes intersect. These 3D cavities couple to each other via the same evanescent tubes used to form the 3D cavities, thereby producing a lattice. Although not shown in FIG. 5E, the evanescent tubes may be alternatively configured as a one-dimensional lattice, three-dimensional lattice, biperiodic lattice, non-rectangular lattice (e.g., kagome or hexagonal lattice) or another type of lattice known in the art.

More generally, single-cavity geometries like those shown in FIGS. 5A-5D may be combined in any number of ways to create coupled-cavity geometries in which a plurality of 3D cavities are coupled to each other via the same evanescent tubes used to form the 3D cavities. The lattice geometry of FIG. 5E is one example of a coupled-cavity geometry in which the 3D cavities are regularly spaced and coupled to their neighbors with an identical coupling strength. However, there is no requirement that that these inter-cavity couplings be regular or constant, or that the 3D cavities be regularly spaced. These coupled-cavity geometries may be useful for studying quantum many-body physics with millimeter-wave photons and multiple emitters, particularly for applications where optical access to the emitters is needed or beneficial.

FIGS. 5A-5E also illustrate an alternative method for fabricating the millimeter-wave cavity of the present embodiments. Rather than drilling holes into a piece of metal, metal tubes may be fused together (e.g., welding or brazing). To ensure the resulting 3D cavity is seamless, the fusing should be performed from the inside of the evanescent tubes. The resulting internal joints may be smoothed out using techniques known in the art (e.g., filing, grinding, drilling, milling, etc.), after which the resulting structure may be cleaned and chemically etched.

Figure 6:
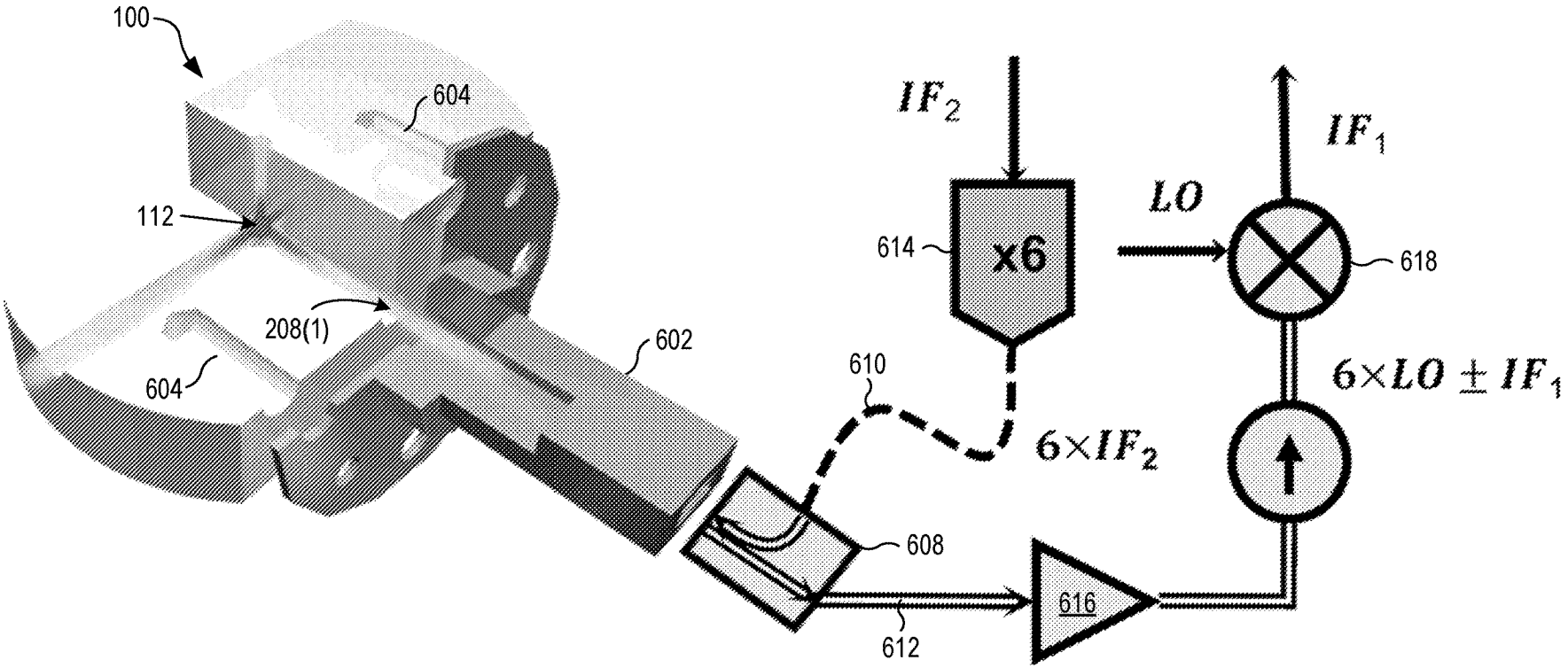
FIG. 6 is a functional diagram showing how the millimeter-wave resonator of FIG. 1 may be used as part of a millimeter-wave circuit.

FIG. 6 is a functional diagram showing how the millimeter-wave resonator 100 may be used as part of a millimeter-wave circuit. Specifically, FIG. 6 shows how the reflection coefficient $S_{11}$ of the 3D cavity 112 may be measured when the resonator 100 is cryogenically cooled (e.g., to a temperature of 1 K). For clarity in FIG. 6, the double solid lines represent hollow millimeter-wave waveguides, the dashed line represented a millimeter-wave coaxial cable, and the single solid lines represents microwave coaxial cables. However, other components, setups, and measurements techniques may be used without departing from the scope hereof.

In general, electromagnetic waves may be coupled into or out of any of the ports 208. In the example of FIG. 6, source waves 610 are fed into the port 208(1) via a waveguide 602 that affixes to the resonator 100 via screw holes 604. The source waves 610 have a frequency below the cutoff frequency of the first evanescent tube 102(1), and therefore excite an evanescent mode that couples to a mode of the cavity 112 that is below cutoff. Due to the finite Q of the 3D cavity 112, some of the energy stored in the cavity mode will leak out of the 3D cavity 112, giving rise to reflected waves 612. A directional coupler 608 separates the reflected waves 612 from the source waves 610. Although not shown in FIG. 6, leakage from the 3D cavity 112 may be alternatively or additionally measured at any of the other ports 208.

To access the millimeter-wave regime, a multiplier 614 may upconvert an intermediate-frequency signal $IF_2$ by an integer factor (e.g., six in the example of FIG. 6). An amplifier 616 may amplify the reflected waves 612. The amplifier 616 may be a cryogenic amplifier located proximate to the resonator 100, waveguide 602, and directional coupler 608 within a cryostat. A mixer 618 may downconvert the output of the amplifier 616 into an intermediate-frequency signal $IF_1$, which may then be processed to determine the amplitude and phase response of the 3D cavity 112.

Figure 7:
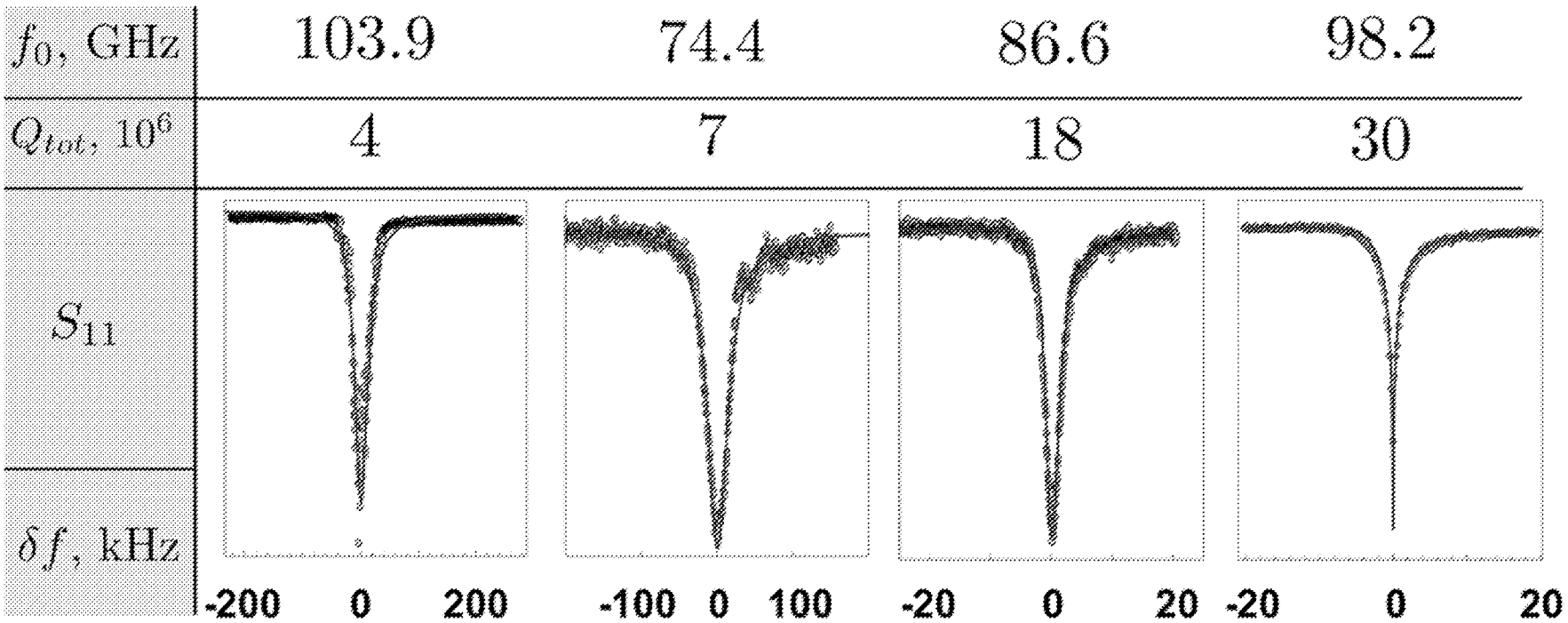
FIG. 7 shows experimental results obtained from four prototypes of the millimeter-wave resonator of FIG. 1.

FIG. 7 shows experimental results obtained from four prototypes of the millimeter-wave resonator 100. All of these prototypes were fabricated by drilling holes into high-purity niobium stock, followed by BCP etching (as described above). The prototypes had different numbers of evanescent tubes 102 as well as evanescent tubes 102 of various lengths and diameters, thereby leading to fundamental cavity modes with different resonant frequencies and internal Qs. FIG. 7 shows the fundamental resonances that were observed in measurements of $S_{11}$ (using the setup in FIG. 6). For BCP-etched cavities, internal Qs in the tens of millions are consistently obtained. In the absence of BCP etching, the internal Qs are two orders of magnitude lower. All of these 3D cavities have mode volumes below $0.2\lambda^3$, which allows for tight confinement of millimeter-wave photons for tens of microseconds at 1 K using evanescence of the tubes 102 alone.

The inventors have performed additional experiments that indicate that the internal Q of these prototype resonators, when superconducting at the lowest temperatures, is not limited by two-level system absorbers (as is common in 2D resonators) or thermal quasiparticles in the superconductor. Another potential loss mechanism is magnetic flux pinning, which could be reduced by adding magnetic shielding. Another potential loss mechanism is photon leakage at the coupling boundary (e.g., where the waveguide 602 meets the port 208(1) in FIG. 6). This loss mechanism could be mitigated by sealing the rectangular-to-circular transition at the port 208(1).

Millimeter waves that are coupled into the first evanescent tubes 102(1) excite an evanescent mode in the first evanescent tubes 102(1) when the frequency of the millimeter waves are below cutoff. This evanescent mode has an electric field amplitude of the form $e^{-\beta x}$, where x is the distance along the tube axis 206(1), as measured from the port 208(1). The propagation constant is $=\sqrt{\omega^2-\omega_c^2}/c$, where $\omega$ is frequency of the millimeter waves, $\omega_c$ is the cutoff frequency of the first evanescent tube 102(1), and c is the speed of light. Below cutoff, the propagation constant is real, causing the electric field amplitude to decrease exponentially along the tube axis 206(1). As a result, the first evanescent tube 102(1) acts as an attenuator, where the amount of attenuation depends on both the length of the first evanescent tube 102(1) and the frequency $\omega$. Similar arguments hold when millimeter waves below cutoff are coupled into any of the evanescent tubes 102.

Critical coupling occurs when the amount of millimeter-wave energy leaking out of the first evanescent tube 102(1) is similar to that absorbed by the walls of the 3D cavity 112. Overcoupling occurs when most of the millimeter-wave energy leaks out via the first evanescent tube 102(1), while undercoupling occurs when most of the millimeter-wave energy is absorbed by the walls. These coupling regimes have different use cases. In the present embodiments, the coupling regime can be selected by adjusting the lengths of the evanescent tubes 102, the radii of the evanescent tubes 102, or both.

Figure 8A:
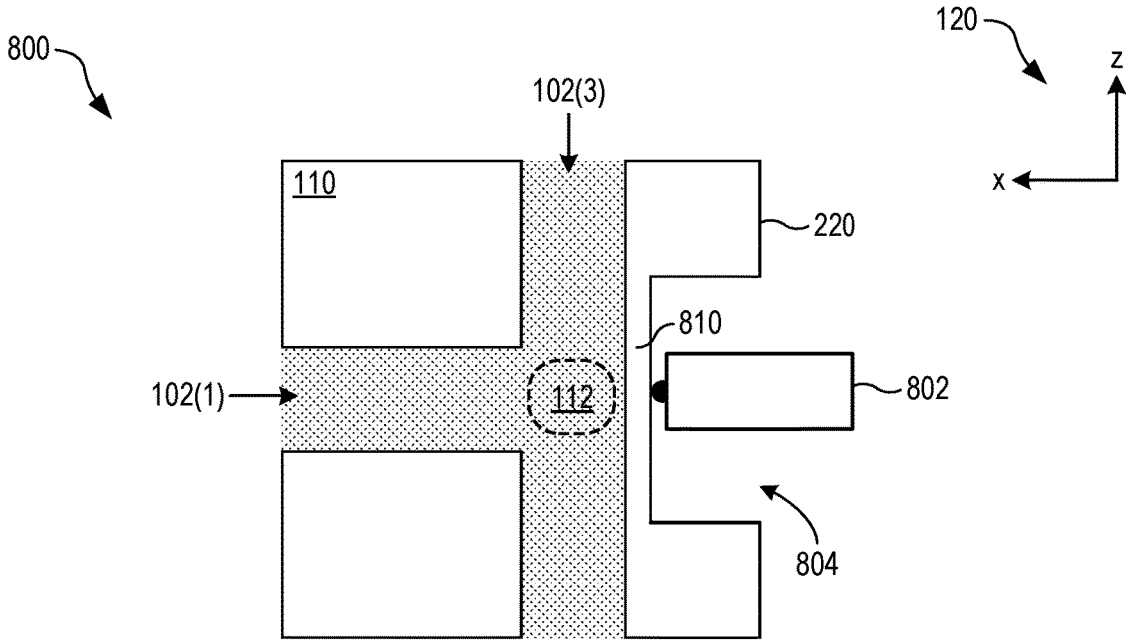
FIG. 8A is a side cut-away view of a tunable millimeter-wave resonator that is similar to the millimeter-wave resonator of FIGS. 1 and 2A-2B except that a pocket has been machined into the rear external face of the piece of metal, in an embodiment.

FIG. 8A is a side cut-away view of a tunable millimeter-wave resonator 800 that is similar to the millimeter-wave resonator 100 of FIGS. 1 and 2A-2B except that a pocket has been machined into the rear external face 220 of the piece of metal 110. This pocket thins a wall 810 of the 3D cavity 112. An actuator 802, when controlled (e.g., electrically) exerts a force onto the exterior surface of the wall 810, thereby deflecting the wall 810, changing the volume of the 3D cavity 112, and thus shifting the resonant frequency. In some embodiments, the actuator 802 is a piezoelectric transducer (e.g., PZT ceramic). However, the actuator 802 may be another type of component or devices that can be controlled to exert a force on the wall 810 without departing from the scope hereof (e.g., a linear motor, hydraulic actuator, electromechanical actuator, etc.).

Figure 8B:
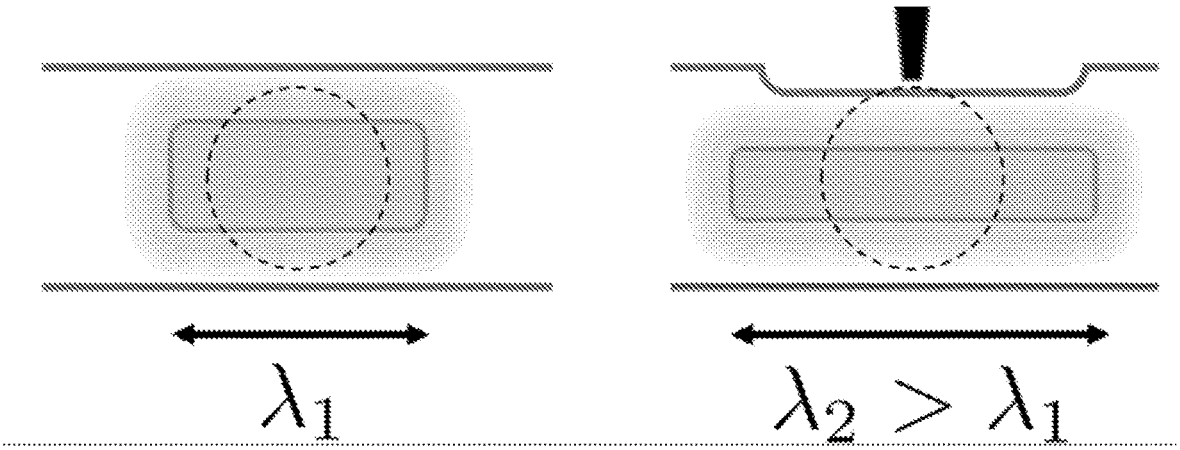
FIG. 8B illustrates frequency tuning of the millimeter-wave resonator of FIG. 8A in more detail.

FIG. 8B illustrates frequency tuning of the millimeter-wave resonator 800 in more detail. Deflection of the wall 810 towards the center of the 3D cavity 112 pushes the cavity mode farther into the evanescent tubes 102, thereby increasing the size of the mode in the direction parallel to the wall 810. The increased cavity size supports a mode with higher wavelength, and therefore actuation of the actuator 802 increases the resonant wavelength from $\lambda_1$ to $\lambda_2>\lambda_1$, which is equivalent to reducing the resonant frequency.

Figure 8C:
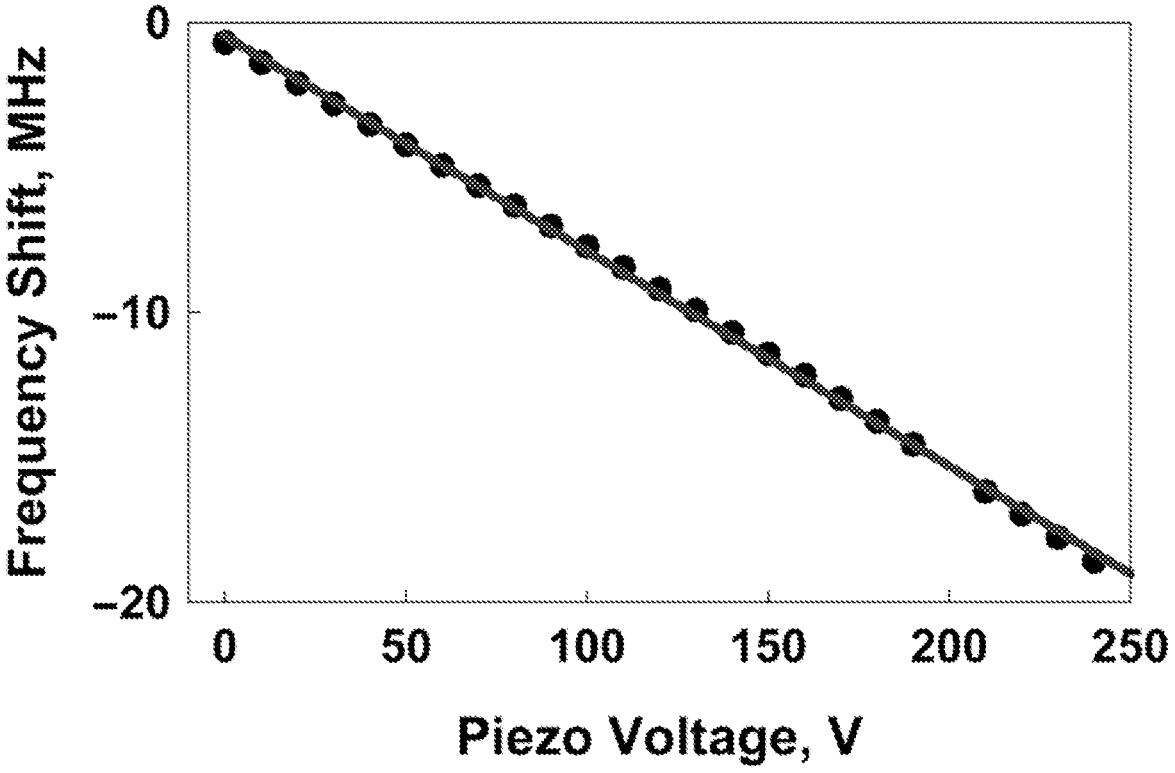
FIG. 8C is a plot of frequency shift of the cavity resonance as a function of voltage applied to a piezoelectric transducer.

FIG. 8C is a plot of frequency shift of the cavity mode as a function of voltage applied to a piezoelectric transducer that serves as the actuator 802. The data is FIG. 8C was measured using a prototype of the resonator 800 that was cryogenically cooled to 1 K. A linear fit to the data points shows a tunability of ~0.1 MHz/V and a maximum shift of ~18 MHz (corresponding to a maximum displacement of the wall 810 of 1-2 μm). At room temperature, the piezoelectric transducer has increased tunability, allowing the resonant frequency to be tuned by several gigahertz. While tunability is powerful, the thinned wall 810 increases mechanical coupling to the environment, which can result in fluctuations of the resonant frequency by several linewidths in the presence of mechanical vibrations (e.g., due to a pulse-tube cryocooler).

Figure 9A:
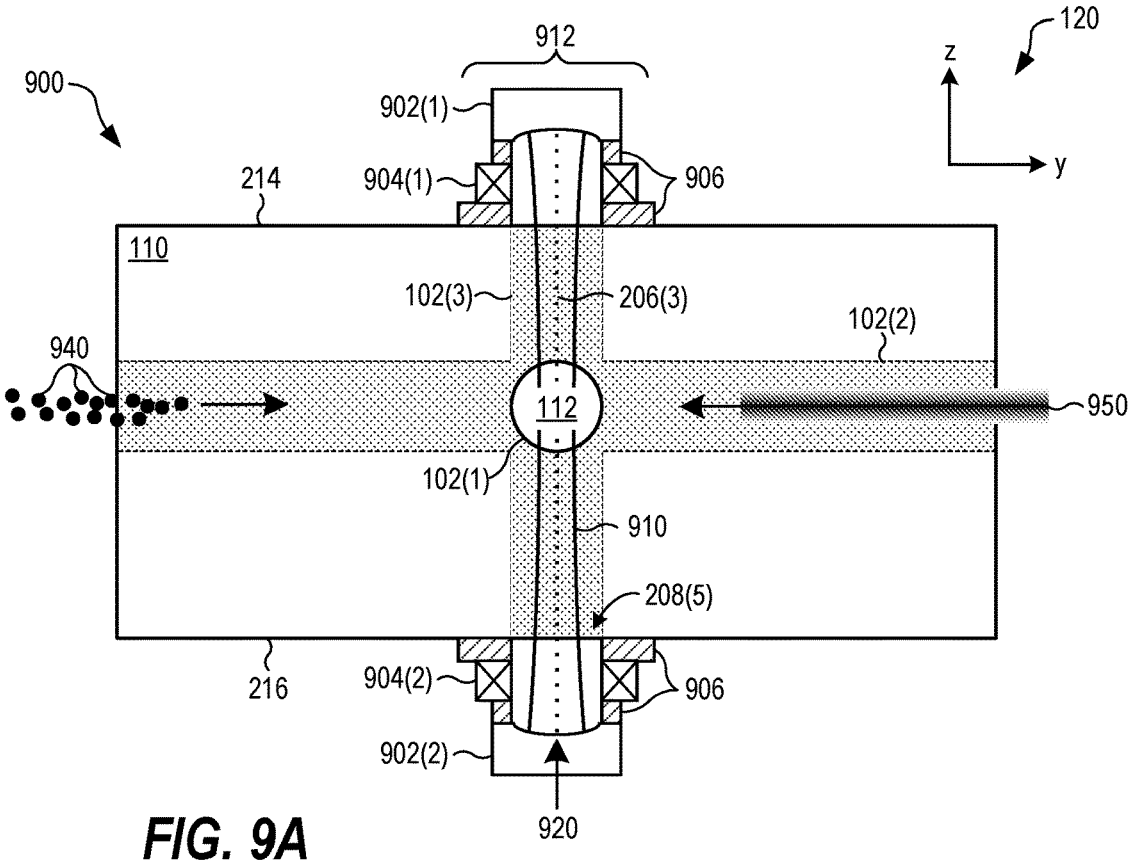
FIG. 9A is a side views of a hybrid resonator that combines millimeter-wave and optical cavities within one structure, in an embodiment.
Figure 9B:
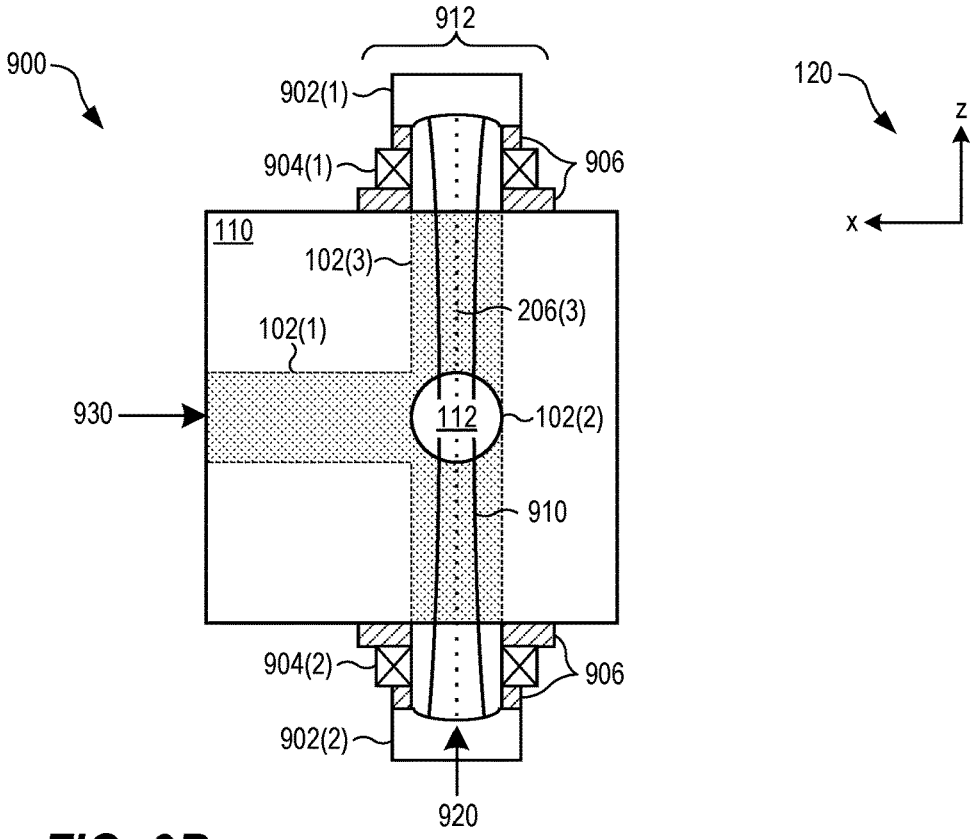
FIG. 9B is another side view of the hybrid resonator of FIG. 9A.

FIGS. 9A and 9B are two side views of a hybrid resonator 900 that combines millimeter-wave and optical cavities within one structure. The hybrid resonator 900 is similar to the resonator 100 of FIGS. 1 and 2A-2B except that the piece of metal 110 serves as a spacer for an optical cavity 912. Millimeter-waves 930 coupled into the first evanescent tube 102(1) excite evanescent modes that couple to one or more modes of the 3D cavity 112. The optical cavity 912 includes a first mirror 902(1) that is affixed to the top external face 214 of the piece of metal 110, and a second mirror 902(2) that is affixed to the bottom external face 216 of the piece of metal 110. The reflective surface of the first mirror 902(1) covers the port 208(4) while the reflective surface of the second mirror 902(2) covers the port 208(5). The mirrors 902(1) and 902(2) face each other to form optical modes 910.

As shown in FIG. 9A, the mirrors 902(1) and 902(2) are positioned such that the optical modes 910 are co-axial with the third tube axis 206(3). Advantageously, the arrangement ensures that the optical modes 910 can be excited (see laser light 920) without incurring losses due to diffraction off the walls of the third evanescent tube 102(3). Minimizing such diffraction losses prevents degradation of the Q of the optical modes 910. Thus, the third evanescent tube 102(3) provides optical access for the optical modes 910, thereby allowing the optical modes 910 to spatially overlap a cavity mode of the 3D cavity 112.

In FIGS. 9A and 9B, the mirrors 902(1) and 902(2) are convex. In this case, the optical cavity 912 is confocal, and the optical modes 910 have a focus that coincides with the 3D cavity 112. This arrangement may be useful, for example, for trapping cold atoms in a red-detuned optical lattice such that the atoms are spatially overlapped with, and therefore coupled to, a cavity mode of the 3D cavity 112. However, the mirrors 902(1) and 902(2) may be alternatively shaped to form another type of optical cavity. For example, when the mirrors 902(1) and 902(2) are planar, the optical cavity 912 is a Fabry-Perot cavity. Other examples of optical-cavity geometries include, but are not limited to, half-confocal, concentric, hemispherical, and concave-convex.

In some embodiments, the optical cavity 912 includes one or both of a first piezoelectric transducer 904(1) and a second piezoelectric transducer 904(2). A voltage applied to either or both of the piezoelectric transducers 904(1) and 904(2) changes the length of the optical cavity 912, and therefore may be used to electrically tune the resonant frequencies of the optical modes 910. However, when such tunability is not needed, the mirrors 902(1) and 902(2) may be affixed directly to the piece of metal 110. One or more spacers 906 may be used to improve the thermal stability of the optical cavity 912 by reducing differential thermal contractions. The spacers 906 may be made of invar or another material that has a low coefficient of thermal expansion (e.g., ZERODUR® glass-ceramic or ultra-low expansion glass).

Without departing from the scope hereof, the optical cavity 912 may be alternatively positioned to be co-axial with the tube axis 206 of another evanescent tube 102 that passes entirely through the piece of metal 110 (e.g., the second evanescent tube 102(2), but not the first evanescent tube 102(1) in FIGS. 9A and 9B). In some embodiments, the hybrid resonator 900 includes multiple optical cavities 912, each of which is co-axial with a different evanescent tube 102 such that all of the optical cavities 912 intersect the 3D cavity 112. In one example of these embodiments, the hybrid resonator 900 includes a first optical cavity 912 that is co-axial with the third evanescent tube 102(3), as shown in FIGS. 9A and 9B, and a second optical cavity 912 that is co-axial with the second evanescent tube 102(2). These optical cavities 912 may be used, for example, to trap atoms in a 2D lattice that spatially overlaps the 3D cavity 112. In another example, a third optical cavity 912 is included to trap atoms in a 3D lattice.

FIG. 9A also shows that the spatial access provided by the evanescent tubes 102 can be used to transport cold or ultracold atoms 940 to the 3D cavity 112. Advantageously, this arrangement allows the atoms 940 to be prepared (e.g., laser-cooled, trapped, evaporatively cooled) outside of the hybrid resonator 900, where it may be easier or more efficient to prepare them. In FIG. 9A, the atoms 940 may be transported along the second evanescent tube 102(2) using a moving optical trap (e.g., optical tweezers), a moving magnetic trap or magnetic guide, or another cold-atom transport technique known in the art. When using light-based techniques to transport atoms, it may be beneficial to use an evanescent tube 102 that passes completely through the piece of metal 110, as shown in FIG. 9A, thereby providing optical access to the atoms 940 from two opposite directions. However, the atoms 940 may be alternatively transported along an evanescent tube 102 that does not pass entirely through the piece of metal 110 (e.g., the evanescent tube 102(1) in FIGS. 9A and 9B).

Although not shown in FIGS. 9A and 9B, the hybrid resonator 900 may additionally include the actuator 802 of FIG. 8. Furthermore, the piece of metal 110 may be machined with the thinned wall 820 to facilitate deformation using the actuator 802. Thus, in some of these embodiments, the hybrid resonator 900 includes at least two piezoelectric transducers: one for deforming the 3D cavity 112 to tune the millimeter-wave resonant frequency, and at least one for tuning the resonant frequencies of the optical modes 910. However, one or more of these at least two piezoelectric transducers may be replaced with another type of actuator without departing from the scope hereof.

FIG. 9A also shows how the evanescent tubes 102 provide optical access to atoms trapped in the 3D cavity 112. Specifically, FIG. 9A shows a laser beam 950 propagating along the second evanescent tube 102(2). The laser beam 950 may be used, for example, to excite, optically pump, or coherently drive the trapped atoms. In one example, a portion of the laser beam 950 that is unabsorbed by the trapped atoms continues propagating down the second evanescent tube 102(2) to exit the hybrid resonator 900. A camera may then be used to record the unabsorbed portion, thereby implementing absorption imaging of the trapped atoms. Alternatively, a photodetector may be used to measure fluorescence emitted by the trapped atoms. Additional evanescent tubes 102 increase optical access (e.g., see FIGS. 5C and 5D), thereby allowing more laser beams 950 to reach the 3D cavity 112.

Figure 10A:
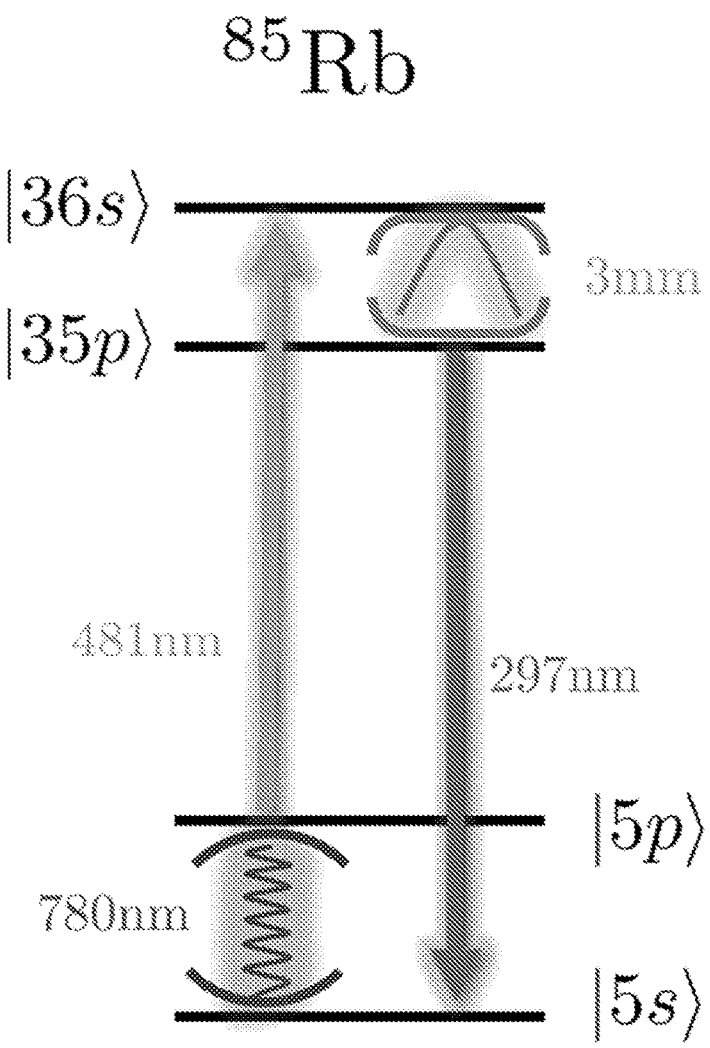
FIG. 10A is an energy-level diagram showing four states of $^{85}$Rb that may be used to entangle and inter-covert single optical and millimeter-wave photons.
Figure 10B:
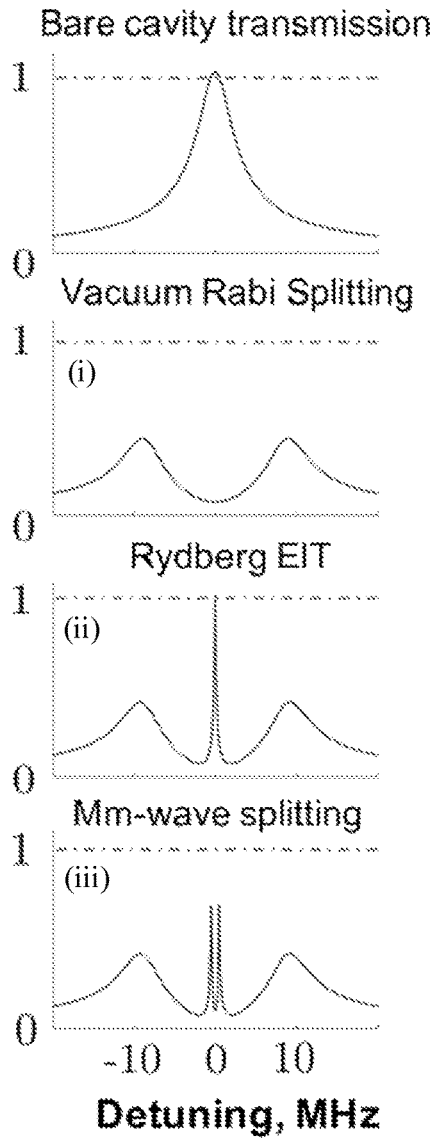
FIG. 10B shows simulations of electromagnetically induced transparency for a Rydberg-atom cavity quantum electrodynamics system that uses the hybrid resonator of FIGS. 9A and 9B, in an embodiment.

FIGS. 10A and 10B illustrate how the hybrid resonator 900 of FIGS. 9A and 9B can be used to achieve strong coupling in a Rydberg-atom cavity quantum electrodynamics system. For clarity, FIGS. 10A and 10B consider Rydberg states of $^{85}$Rb, whose energy-level structure is well-known, and for which cooling and trapping techniques are readily implemented using techniques known in the art. However, another atomic species made be used instead without departing from the scope hereof (e.g., cesium, potassium, strontium, helium, etc.).

FIG. 10A is an energy-level diagram showing four states of $^{85}$Rb that may be used to entangle and inter-covert single optical and millimeter-wave photons. A 780-nm optical photon in the optical cavity 912 is resonant with the transition between the ground $|5S_{1/2}\rangle$ and excited $|5P_{3/2}\rangle$ states. The coupling strength $g_o$ and cooperativity $C_o$ between one $^{85}$Rb atom and a single optical photon are given by $$\frac{g_o}{2\pi} = \frac{d_o E_o}{2\pi\hbar} = 600 \text{ kHz}$$

$$C_o = \frac{24F}{\pi}\frac{1}{(kw_0)^2} = 0.2,$$

where $d_o = \langle 5S|er|5P\rangle$ is the dipole moment, $E_o$ is the electric-field strength of one optical photon at the location of the atom, F is the finesse of the optical cavity 912, k is the wavevector of the optical mode 910, and $w_o$ is the waist of the optical mode 910. The single-atom interaction can be boosted by $N_a$ due to coherent interaction between a cloud of $N_a$ cold atoms and a single photon.

For the millimeter-wave transition between the $|35P\rangle$ and excited $|36S\rangle$ states, the cooperativity between a Rydberg atom and a single millimeter-wave photon is much higher due to strong confinement of 100 GHz in the 3D cavity 112. The coupling strength $g_{mm}$ and cooperativity $C_{mm}$ are given by $$\frac{g_{mm}}{2\pi} = \frac{d_{mm}E_{mm}}{2\pi\hbar} = 460 \text{ kHz}$$

$$C_{mm} = \frac{4g_{mm}^2}{\Gamma\kappa} = 22000,$$

where $\Gamma$ is the linewidth of the $|36S\rangle$ state and $\kappa = f_0/Q$ is the linewidth of the 3D cavity 112. The high strength of the interaction is the result of the large Rydberg dipole moment $d_{mm} = \langle 35P|er|36S\rangle$ and tight confinement of the millimeter-wave photon in the 3D cavity 112.

With the hybrid resonator of FIGS. 9A and 9B, a cloud of cold atoms trapped in an optical lattice can enter the 3D cavity 112 through one of the evanescent tubes 102, thereby allowing the atoms to be simultaneously trapped at the waist of the optical mode 910 and within the 3D cavity 112. There, the atoms can interact efficiently with both millimeter-wave and optical photons. To facilitate this interaction, electromagnetically-induced transparency (EIT) may be used by coupling the $|5S\rangle$ and $|36S\rangle$ states with a blue laser light at 481 nm. FIG. 10B shows simulations of this effect. The top panel of FIG. 10B shows a Lorentzian peak corresponding to bare transmission (i.e., without atoms) through the optical cavity 912. Weak probing of the optical cavity 912 creates (i) vacuum Rabi splitting of the optical transition due to presence of the cold atomic cloud, (ii) cavity EIT in the presence of the blue laser light, and (iii) splitting of the EIT peaks proportional to the square root of number of millimeter-wave photons in the 3D cavity 112. The strong coupling between single optical and millimeter-wave photons through interactions with atoms may be used for entanglement and manipulation of millimeter-wave photons using optical light and vice versa. For interconversion of millimeter-wave and optical photons, ultraviolet light at 297 nm drives the transition between the $|35S\rangle$ and $|5S\rangle$ states, as needed for coherent and bidirectional conversion and quantum information transfer.

The following steps may be performed to tune the resonant frequency of the 3D cavity 112 such that it matches the millimeter-wave transition frequency of the Rydberg atoms. First, the piece of metal 110 is machined such that the resonant frequency is greater than, but within 1 GHz of, the transition frequency. Then, the piece of metal 110 is chemically etched to reduce the resonant frequency to within 100 MHz of the transition frequency. The inventors have discovered that the shift in resonant frequency, as a function of etch time, is reproducible. Based on several measurements, they approximate the etch rate to be approximately 6 μm/min. Accordingly, the etch time can be calculated based on a measured difference between the resonant and transition frequencies. Before cryogenic cooling, the resonant frequency may be further tuned (typically up to 1 GHz) using mechanical squeezing. For example, a hydraulic press may be used to plastically deform the piece of metal 110 in a permanent manner. After cooling, the resonant frequency typically shifts by about 10 MHz, which can be corrected using the actuator 802.

To achieve a large value of $C_{mm}$, it is advantageous to use a cavity mode of the 3D cavity 112 with this highest internal Q. This is typically the lowest-frequency, or fundamental, mode. However, there may be additional modes that are also below cutoff, and therefore also have high internal Qs. These additional modes may be used, for example, to shift Rydberg-atom energy levels via AC polarizability. Furthermore, the 3D cavity 112 will have higher-frequency modes that are above cutoff. These above-cutoff modes typically have lower Q since they couple to the waveguide modes of the evanescent tubes 102. Although these higher modes may not be well-suited for achieving the largest cooperativities, they may still be used for other purposes or applications where high Qs are not required.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A millimeter-wave resonator, comprising:

a piece of metal forming first and second evanescent tubes that extend linearly into the piece of metal from an external surface of the piece of metal;

wherein the first and second evanescent tubes at least partially intersect to form a seamless three-dimensional cavity whose fundamental cavity mode has a resonant frequency that is less than a first cutoff frequency of the first evanescent tube and a second cutoff frequency of the second evanescent tube.

2. The millimeter-wave resonator of claim 1, further comprising:

a first mirror affixed over a first port formed where a first end of the first evanescent tube intersects the external surface; and a second mirror affixed over a second port formed where a second end of the first evanescent tube intersects the external surface;

wherein the first and second mirrors face each other to form an optical cavity that is co-axial with the first evanescent tube.

3. A millimeter-wave method, comprising:

cryogenically cooling the millimeter-wave resonator of claim 2 to a temperature below a critical temperature of the metal;

coupling millimeter-waves into the first evanescent tube to excite an evanescent mode of the first evanescent tube, the evanescent mode coupling to at least one cavity mode of the seamless three-dimensional cavity, the at least one cavity mode having a resonant frequency less than the first and second cutoff frequencies; and coupling light into the optical cavity to excite an optical mode of the optical cavity.

4. The millimeter-wave resonator of claim 1, the piece of metal further forming a third evanescent tube that extends linearly into the piece of metal from the external surface to intersect the seamless three-dimensional cavity;

wherein the resonant frequency is also less than a third cutoff frequency of the third evanescent tube.

5. A millimeter-wave method, comprising:

cryogenically cooling the millimeter-wave resonator of claim 4 to a temperature below a critical temperature of the metal;

coupling millimeter-waves into the first evanescent tube to excite an evanescent mode of the first evanescent tube, the evanescent mode coupling to at least one cavity mode of the seamless three-dimensional cavity, the at least one cavity mode having a resonant frequency less than the first and second cutoff frequencies; and transporting atoms along the third evanescent tube to enter the seamless three-dimensional cavity.

6. The millimeter-wave resonator of claim 1, further comprising an actuator affixed to the external surface of the piece of metal;

wherein the actuator is controllable to displace an internal wall of the seamless three-dimensional cavity to change the resonant frequency.

7. A millimeter-wave method, comprising:

cryogenically cooling the millimeter-wave resonator of claim 6 to a temperature below a critical temperature of the metal;

coupling millimeter-waves into the first evanescent tube to excite an evanescent mode of the first evanescent tube, the evanescent mode coupling to at least one cavity mode of the seamless three-dimensional cavity, the at least one cavity mode having a resonant frequency less than the first and second cutoff frequencies; and controlling the actuator to change the resonant frequency.

8. A millimeter-wave method, comprising:

cryogenically cooling the millimeter-wave resonator of claim 1 to a temperature below a critical temperature of the metal; and coupling millimeter-waves into the first evanescent tube to excite an evanescent mode of the first evanescent tube, the evanescent mode coupling to at least one cavity mode of the seamless three-dimensional cavity, the at least one cavity mode having a resonant frequency less than the first and second cutoff frequencies.

9. A millimeter-wave resonator, comprising:

a plurality of evanescent tubes that intersect to form a seamless three-dimensional cavity;

wherein (i) each of the plurality of evanescent tubes has a cut-off frequency and (ii) the seamless three-dimensional cavity has a fundamental cavity mode whose resonant frequency is less than a cutoff frequency of each of the plurality of evanescent tubes.

10. The millimeter-wave resonator of claim 9, wherein each of the plurality of evanescent tubes is linear.

11. A millimeter-wave resonator produced by:

drilling, into a piece of metal, a first hole forming a first evanescent tube having a first cutoff frequency; and drilling, into the piece of metal, a second hole forming a second evanescent tube having a second cutoff frequency;

wherein the first and second holes at least partially intersect to form a seamless three-dimensional cavity whose fundamental cavity mode has a resonant frequency that is less than the first and second cutoff frequencies.

12. The millimeter-wave resonator of claim 11, the first and second holes having a similar diameter.

13. The millimeter-wave resonator of claim 12, the similar diameter being sized such that the first and second cutoff frequencies are millimeter-wave frequencies.

14. The millimeter-wave resonator of claim 11, the first hole passing entirely through the piece of metal.

15. The millimeter-wave resonator of claim 14, further produced by:

affixing a first mirror over a first port formed where a first end of the first hole intersects an external surface of the piece of metal; and affixing a second mirror over a second port formed where a second end of the first hole, opposite to the first end, intersects the external surface;

wherein the first and second mirrors face each other to form an optical cavity that is co-axial with the first evanescent tube.

16. The millimeter-wave resonator of claim 11, further produced by:

drilling, into the piece of metal, a third hole forming a third evanescent tube having a third cutoff frequency, the third hole at least partially intersecting the seamless three-dimensional cavity;

wherein the resonant frequency is also less than the third cutoff frequency.

17. The millimeter-wave resonator of claim 11, further produced by chemically etching, after said drilling the first hole and said drilling the second hole, the piece of metal to treat an internal surface of the first and second evanescent tubes.

18. The millimeter-wave resonator of claim 11, further produced by:

affixing an actuator to contact an outward-facing surface of the piece of metal;

wherein the actuator is controllable to displace an internal wall of the seamless three-dimensional cavity to change the resonant frequency.

19. The millimeter-wave resonator of claim 18, the actuator being a piezoelectric transducer.

20. The millimeter-wave resonator of claim 11, further produced by affixing a waveguide to a port formed where the first hole intersects an external surface of the piece of metal.

21. The millimeter-wave resonator of claim 11, wherein the metal superconducts when cooled below a critical temperature of the metal.

* * * * *